United States Patent [19]

Tserng

[11] Patent Number: 4,856,229

[45] Date of Patent: Aug. 15, 1989

[54] WINDOW GRILLE LATCH DEVICE

[75] Inventor: Ray L. Tserng, Changhua Hsien, Taiwan

[73] Assignee: Chuan Erh Industrial Co., Ltd., Chang Hua Hsien, Taiwan

[21] Appl. No.: 197,093

[22] Filed: May 20, 1988

[51] Int. Cl.[4] ..... E06B 3/68

[52] U.S. Cl. ..... 49/56; 49/141; 292/252

[58] Field of Search ..... 49/56, 57, 141; 292/252, 261, 299

[56] References Cited

U.S. PATENT DOCUMENTS 4,111,477 9/1978 Rigali ..... 292/252

4,263,747 4/1981 Coltrin ..... 49/141

*Primary Examiner*—Kenneth J. Dorner

*Assistant Examiner*—Gerald A. Anderson

*Attorney, Agent, or Firm*—Renner, Otto, Boisselle & Sklar

[57] ABSTRACT

A window grille latch device comprising an arm with a hollow tube which has a pair of steel balls received in a pair of holes formed in the hollow tube, a latch means having a inner hollow tube and a outer hollow tube to receive the hollow tube, a convex ring recess formed in the inner hollow tube to receive the steel balls, a slide bar received in the inner hollow tube to contact with the steel balls, a cable with a cover connecting with the rear end of the slide bar and a control means connecting to the cable for releasing the latch means.

3 Claims, 6 Drawing Sheets

WINDOW GRILLE LATCH DEVICE

BACKGROUND OF THE INVENTION

Metal grilles and grates are mounted on exterior of windows of a building. Conventional grilles and grates are permanently affixed into the wall adjacent to the window in order to prevent unauthorized entry. For escape in emergency, the grilles and grates have a door which can be open and closed. When the door is closed, a lock mechanism is employed However, it always happens that the key for releasing the lock mechanism can not be found in emergency.

A further window grille latch system has been disclosed in U.S. Pat. No. 4,263,747 by Coltrin et al. The window grille latch system comprises a hinge and a latching assembly mounted on the wall adjacent to both sides of the window. The grille is hinged with the hinge at one side and locked with the latching assembly at the other side. With a cable being pulled, the latching assembly releases a cylindrical penetrator member, so that the grille can be "open" for escaping.

Such window grille latch system includes a large number of components which is complex and difficult for manufacturing and fabricating. Also, it is rather expensive. In operation, separating upper and lower latch member in order to release the cylindrical penetrator member requires great force. Once there is any component out of order, the movement of upper latch member will be very difficult.

SUMMARY OF THE INVENTION

An objective of the present invention is to provide a grille latch system which reduces the number of components for easily manufacturing, assemblying and operating and reduces the cost.

A further objective of the present invention is provided with a pair of steel balls which can be moved into or from a convey ring recess by a slide bar to lock or release the grille latch system.

Another objective of the present invention is provided with a control means which can be operated by a foot to release the grille latch system.

DETAILED DESCRIPTION OF THE PREFERRED EMBODIMENT

Figure 1:
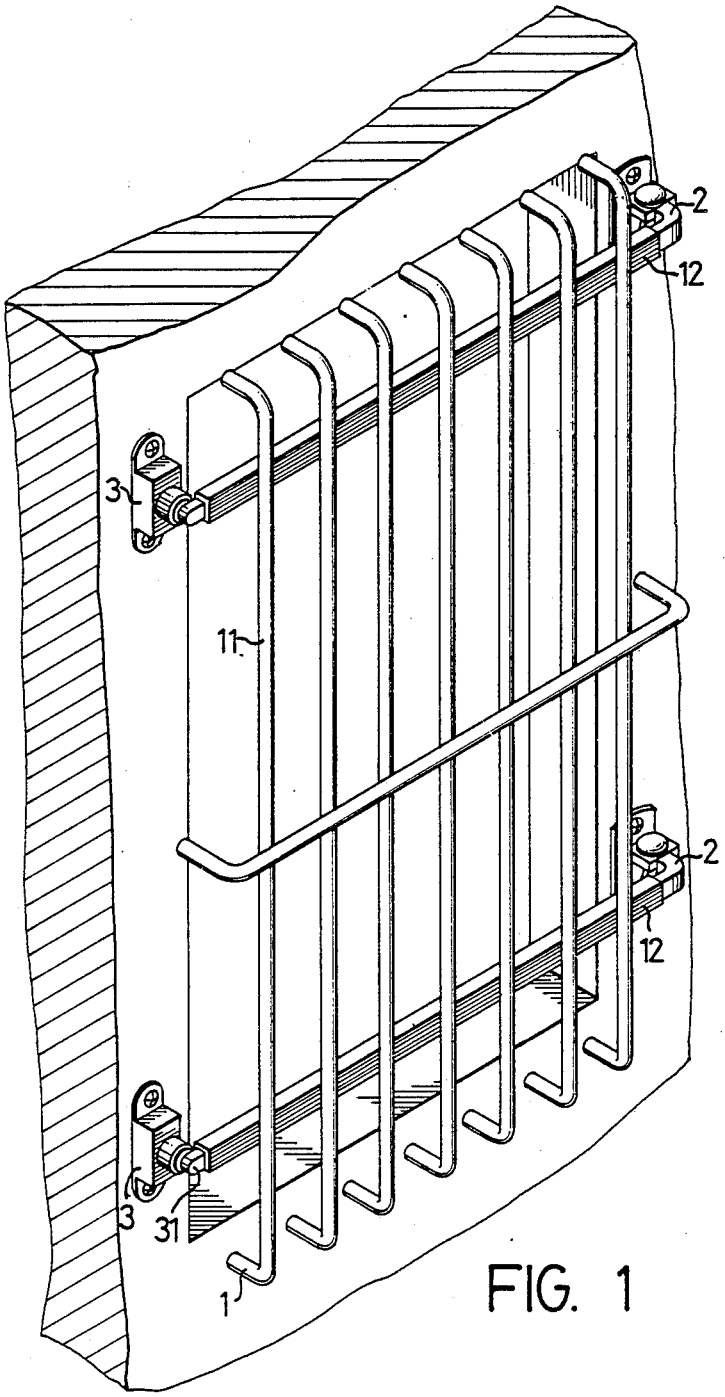
FIG. 1 is a perspective view of a window grille mounted on a wall of a building.

Referring to FIG. 1, a grille 1 includes a plurality of vertical and horizontal steel bars 11 and 12. A pair of horizontal bars 12 are connected to the wall, for example, right end 2 of the horizontal bar 12 is hinged with a hinged mounted on the wall and left end of the horizontal bar 12 has an arm 31 to engage with a latch means 3.

Figure 2:
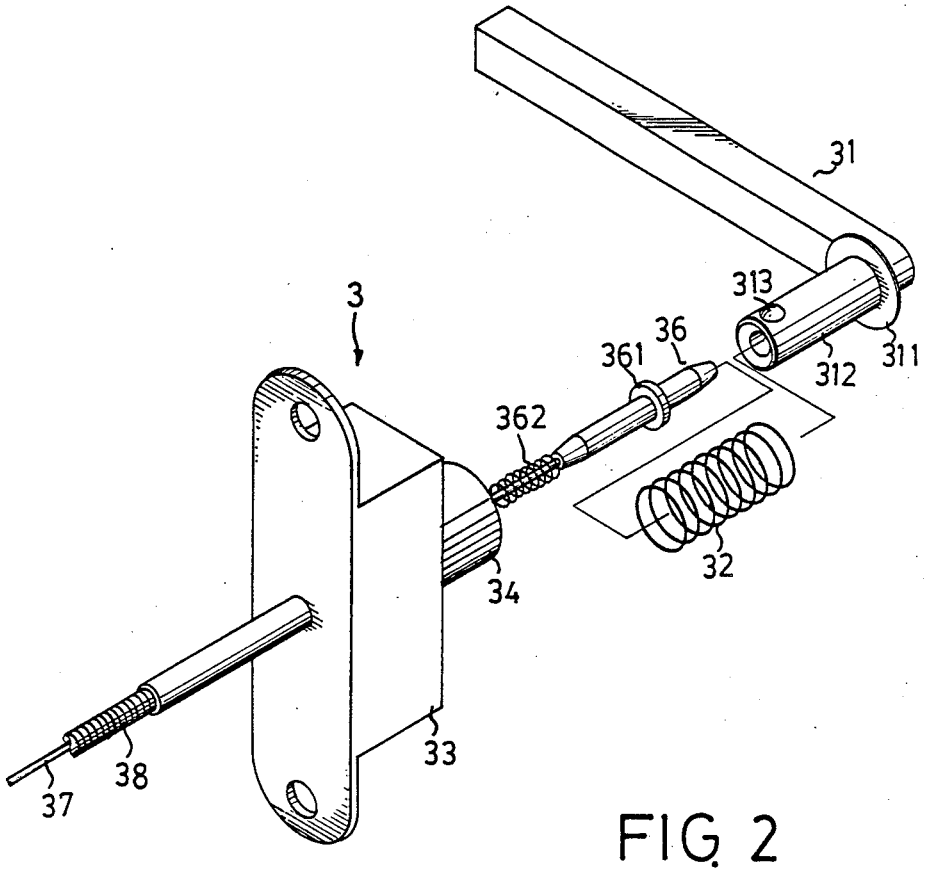
FIG. 2 is an exploded view of a latch device according to the present invention.
Figure 3:
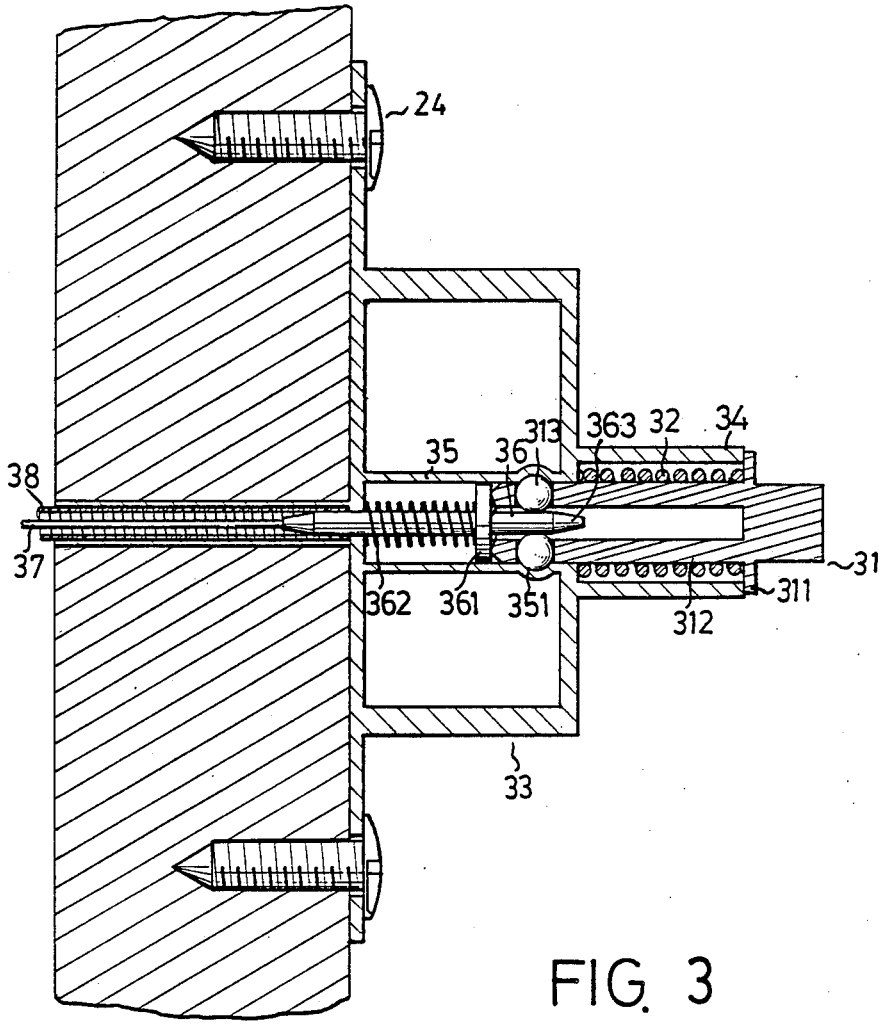
FIG. 3 is a cross-section view of the latch device of FIG. 2.

As shown in FIGS. 2 and 3, the arm 31 has a hollow tube 312 rectangularly extending. The hollow tube 312 has a exterior flange 311 disposed at outer end and a pair of holes 313 drilled adjacent to inner end in order to receive a pair of steel balls 351. Latch means 3 comprises a housing 33 in which an inner hollow tube 35 is integerally formed. A outer hollow tube 34 is disposed at the outer surface of the housing having a same axis as that of the inner hollow tube 35. The diameter of the inner hollow tube 35 is greater than that of the hollow tube 312. The diameter of the outer hollow tube 34 is greater than that of the inner hollow tube 35. The hollow tube 312 is inserted through outer hollow tube 34 into the inner hollow tube 35. The inner hollow tube 35 is provided with a convex ring recess 351 aligned with the holes of the hollow tube 312. A spring 32 is disposed in the space between the walls of the outer hollow tube 34 and the hollow tube 312 in compressed state. It is noted that the exterior flange 311 of the hollow tube 312 contacts with the outer end of the outer hollow tube 34 to form a closed condition for the latch means 3.

A slide bar 36 has a tapered portion 363 at front end, a exterior flange 361 at intermediate portion thereof. A rear end of the slide bar 36 is connected with a cable 37 which has a protective cover 38. The slide bar 36 is disposed in the inner hollow tube 35. The rear end of the slide bar 36 is inserted through a hole of the rear wall of the housing 33 and the cable 37 together with the cover 38 extends through the wall of the building to indoor. A further spring 362 encompasses the rear portion of slide bar 36 and is disposed between the rear wall of the housing 33 and the rear surface of the flange 361. When assemblied, the front surface of the flange 361 contacts with the inner end of the hollow tube 312. The front portion with the aid of the tapered front end 363 can be easily inserted into the hollow tube 312 moving outward, so that the steel balls 313 can be received in the convex ring recess 351 of the inner hollow tube 35. Therefore, the arm 31 is engaged with the latch means 3 to prevent unauthorized releasing. With a plurality of screws 24 inserting through the housing 33 into the wall adjacent the window, the latch means 3 is affixed to the wall, as shown in FIG. 3.

Figure 4:
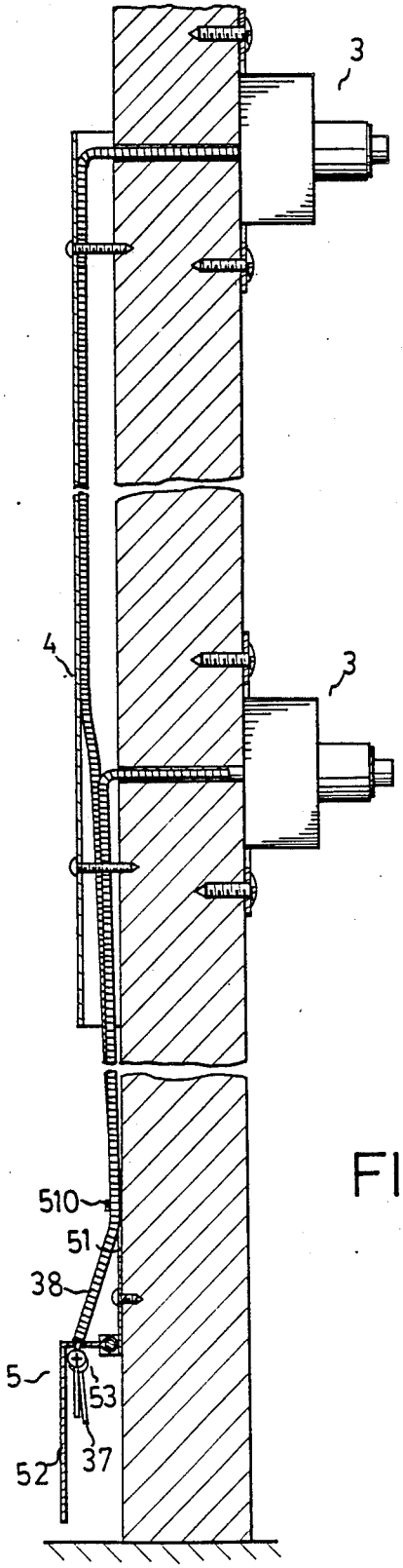
FIG. 4 is a cross-section view showing the latch device connecting to a control means with a cable disposed therebetween.
Figure 5:
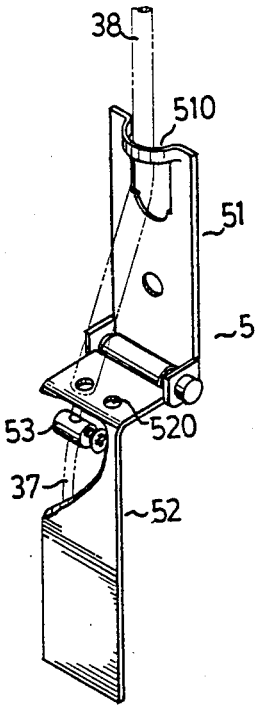
FIG. 5 is a perspective view of the control means.

Referring to FIG. 4 the cover 38 together with the cable 37 downwardly extends along inner surface of the wall. A shield 4 covers the cover 38 and the cable 37 to prevent unauthorized drawing from outsides. The lower ends of the cable 37 and cover 38 extend to near ground and engage with a control means 5. As shown in FIG. 5, the control means 5 comprises a fixed plate 51 secured on inner surface of the wall (as shown in FIG. 4) and an L-shaped plate 52. The L-shaped plate 52 is pivoted with the fixed plate 51. The fixed plate 51 has a semi-circular ring 510 to allow the cable 37 and cover 38 passing therethrough. The cable 37 also passes through a hole 520 formed in the L-shaped plate 52 and engages with a stopper 53 below the horizontal portion of the L-shaped plate 53.

Figure 6:
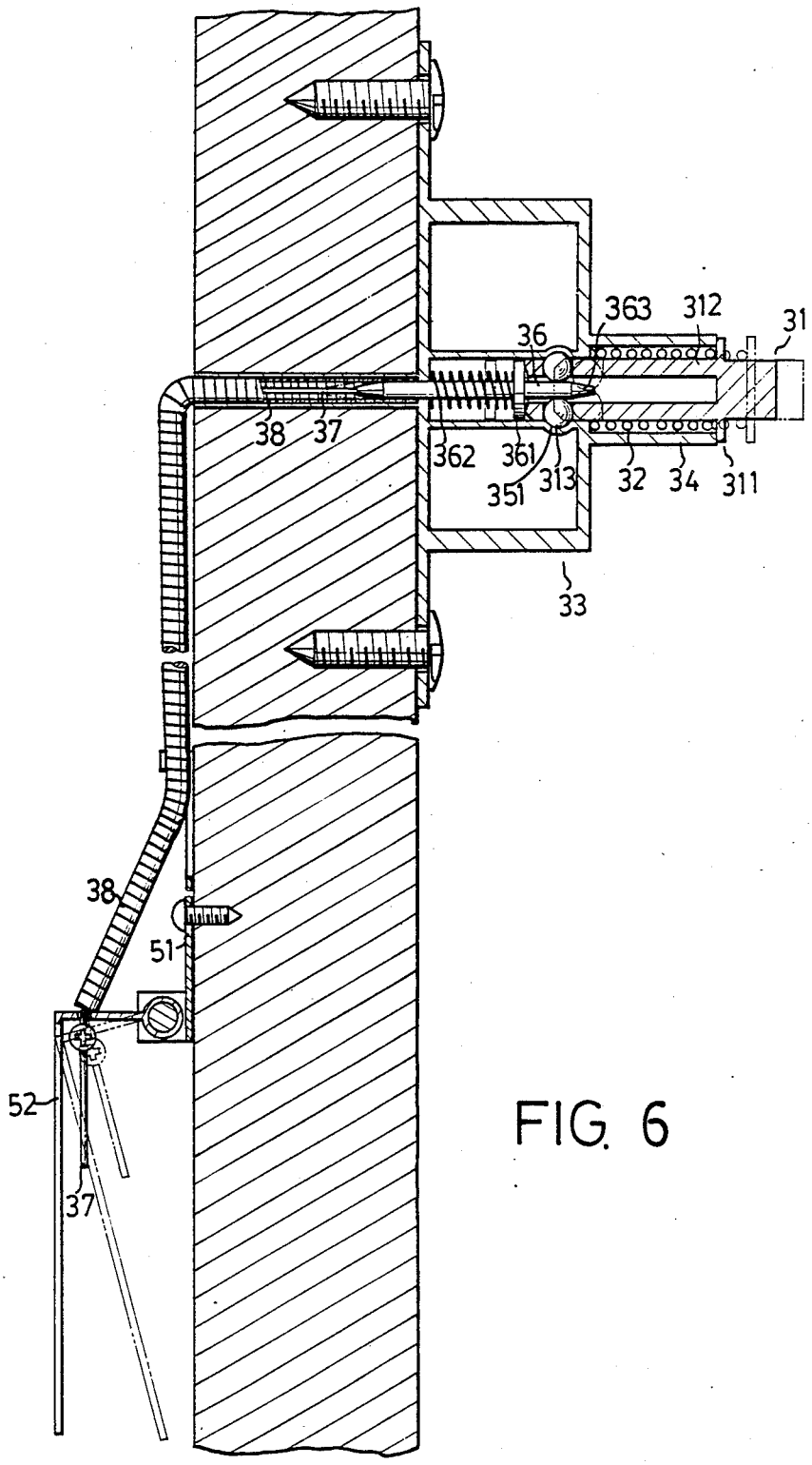
FIG. 6 is a cross-section view of the present invention showing the control means to release the latch means.

As shown in FIG. 6, when the vertical portion of the L-shaped plate 52 is pressed, for example, by a foot, the L-shaped plate 52 draws the cable 37 moving downward, (as shown in broken line) so that the slide bar 36 is moved inwardly. When the front end of the slide bar 36 gets away from the steel balls 313 the steel balls 313 can fall into the hollow tube 312. With the force of the spring 312, the arm 31 and the hollow tube 312 move outward in order to release from the latch means, thereby, the grilles can be open in emergency. By reverse operation, the arm 31 can be reengaged with the latch means.

I claim:

1. A window grille latch device for a grille affixed on a wall adjacent to a window, comprising:

an arm engaged with the grille, said arm including a hollow tube member extending substantially perpendicular to the plane of the grille, said hollow tube member having a pair of holes adjacent to an end of said hollow tube member furthest from the plane of the grille; a pair of balls received in said holes of said hollow tube member; and a first spring encompassing said hollow tube member; and a latch housing assembly affixed on the wall, said housing assembly including a housing having a rear wall; an inner hollow tube extending substantially perpendicularly away from the rear wall; an outer hollow tube co-axial with said inner hollow tube and extending away from the rear wall further than said inner hollow tube, said inner hollow tube being provided with a recess; and a slide bar in said housing, said slide bar including a front portion with a tapered end, an intermediate portion including an exterior flange, and a rear portion inserted through said rear wall of said housing and connected with a cable which has a protective cover; and a second spring encompassing said rear portion of said slide bar;

said hollow tube member being insertable into said outer hollow tube and said inner hollow tube, and when thusly inserted, said hollow tube member receiving said front portion of said slide bar, said exterior flange of said hollow tube contacting an outer end of said outer hollow tube, and said balls being forced by said slide bar to move into said recess of said inner hollow tube.

2. A device as claimed in claim 1, further comprising a control means, said control means including:

a mounting plate secured on an inner surface of the wall, said mounting plate having a semi-circular ring for passage of said cable and cover; and an L-shaped plate pivotly connected to said mounting plate, said L-shaped plate having a hole through which said cable passes and a stopper engaged with an end of said cable.

3. A latch device for releasably securing a grille in a closed position covering an opening in a wall, comprising:

a latch arm attachable to the grille for extension substantially at a right angle to a planar extent of the grille, said latch arm having a tubular end portion, said tubular end portion retaining therein a radially movable interference element; and a latch housing assembly attachable to the wall for matingly engaging said latch arm when the grille is in its closed position, said assembly including a housing having wall means defining an opening for axially inserted receipt of said tubular end portion of said latch arm, said wall means including a detent for axial interference engagement with said interference element and surface means for engaging and moving said interference element within said tubular end portion to a retracted position permitting insertion of said tubular end portion to a position aligning said interference element with said detent, and means for holding said interference element in a radially outwardly extended position to axially interferingly engage said detent when aligned therewith thereby to prevent withdrawal of said latch arm from said housing, said means for holding including an actuator bar axially insertable into said tubular end portion, and resilient means for resiliently outwardly urging said actuator bar, said interference element, when in said retracted position, engaging said actuator bar to cause said actuator bar to move inwardly with said latch arm during insertion of said latch arm into said opening, and said interference element, when in said extended position, clearing said actuator bar to allow said resilient means to move said actuator bar to a position blocking movement of said interference element out of said extended position.

* * * * *